United States Patent [19]

Araoka

[11] 4,456,424

[45] Jun. 26, 1984

[54] UNDERWATER SAND PUMP

[75] Inventor: Toshinobu Araoka, Kitakyushu, Japan

[73] Assignee: Toyo Denki Kogyosho Co., Ltd., Fukuoka, Japan

[21] Appl. No.: 352,619

[22] Filed: Feb. 25, 1982

[30] Foreign Application Priority Data

| | | | |
|---|---|---|---|
| Mar. 5, 1981 | [JP] | Japan | 56-31222[U] |
| Mar. 5, 1981 | [JP] | Japan | 56-31223[U] |
| Mar. 5, 1981 | [JP] | Japan | 56-31224[U] |
| Mar. 5, 1981 | [JP] | Japan | 56-31225[U] |

[51] Int. Cl.[3] ..... F04D 29/70

[52] U.S. Cl. ..... 415/121 G; 415/143; 366/263

[58] Field of Search ..... 415/121 B, 121 G, 143, 415/215; 366/263

[56] References Cited

U.S. PATENT DOCUMENTS

| | | | |
|---|---|---|---|
| 3,312,386 | 4/1967 | Hull et al. | 415/215 |
| 3,500,879 | 3/1970 | Meyer | 141/1 |
| 3,644,056 | 2/1972 | Wiselius | 415/215 |
| 3,973,866 | 8/1976 | Vaughan | 415/121 B X |

FOREIGN PATENT DOCUMENTS

| | | | |
|---|---|---|---|
| 2545736 | 4/1977 | Fed. Rep. of Germany | 415/143 |
| 122065 | 1/1878 | France | 415/215 |
| 211306 | 1/1880 | France | 415/215 |
| 52-30904 | 3/1977 | Japan | 415/121 B |
| 584395 | 1/1947 | United Kingdom | 415/121 B |

*Primary Examiner*—Harvey C. Hornsby
*Assistant Examiner*—Christine A. Peterson
*Attorney, Agent, or Firm*—Jordan and Hamburg

[57] ABSTRACT

An underwater sand pump has an extremely improved sand excavating efficiency by eliminating the occurrence of cavitation and by preventing interference between the agitation flow and the suction flow. Such underwater pump is substantially characterized by disposing flow separating means in a circular opening formed in an end plate of a perforated strainer and by mounting such flow separating means integrally and contiguously on the upper end of the agitator which is mounted on the lower extension of the output shaft of a motor.

7 Claims, 6 Drawing Figures

UNDERWATER SAND PUMP

BACKGROUND OF INVENTION

This invention relates to an underwater sand pump, and more particularly to the improvement of an agitator of the underwater sand pump.

One conventional underwater sand pump comprises an agitator mounted on an output shaft of a motor which, upon rotation, agitates sands in the water bed and whirls sand in an upward direction and a suction pump which sucks the whirled sand along with the whirled water. In such underwater sand pump, however, since the agitator and the suction opening of the suction pump are disposed so close to each other, the downward water stream caused by the agitator and the upward water flow caused by an impeller of the suction pump interfere with each other, thereby the sand excavating operation with such sand pump suffers an extremely poor efficiency.

For resolving the above defects of the above suction pump, an improved type of underwater pump was developed and such pump is disclosed in Japanese Utility Model publication No. 51-38005. The pump is substantially constructed such that a cylindrical perforated strainer with the lower end thereof closed with an end plate is provided between the suction opening and the agitator and a circular opening which has an inner diameter almost equal to the outer diameter of the agitator is formed in the end plate of the perforated strainer and an umbrella-shaped body which loosely engages with the circular opening is mounted on the output shaft of the motor.

Due to such construction, upon rotation of the output shaft of the motor, sand and water can be clearly separated into the agitating flow which moves downward to the sea bed and the suction flow which moves toward the pump by the umbrella-shaped body so that the interference between the agitating flow and the upward flow can be prevented.

However, since the agitator is disposed away from the umbrella-shaped body, a vacuum is often produced in the space between the agitator and the umbrella-shaped body resulting in cavitation. This cavitation causes the vibration of the drive shaft and produces bubbles around the agitators and furthermore, small stones which exist in the sand may hit the pump, thus causing damage to the pump. Therefore, such sand pump is also less than optimal in terms of the sand excavating efficiency as well as the maintenance thereof.

Accordingly, it is an object of the present invention to provide the underwater pump which can overcome all the above defects of conventional underwater pumps. Namely, the underwater pump according to this invention is completly free from cavitation during the sand excavating operation and thereby has an improved excavating efficiency.

The present invention, in summary, discloses an underwater pump comprising an underwater motor having an output shaft thereof extending downwardly on which an impeller is mounted, a pump casing encasing the output shaft, an agitator fixedly attached to the lower extension of the output shaft, the agitator consisting of a truncated cone and a plurality of vanes radially mounted on the circumferential wall of the truncated cone and a cylindrical perforated strainer disposed between a suction inlet of the impeller and the agitator, the strainer being provided with an end plate at the bottom end thereof in which a circular opening is formed, wherein the improvement is characterized in that flow separating means for separating an agitation flow and a suction flow is disposed in the circular opening, that the flow separating means is integrally and contiguously mounted on the upper end of the truncated cone of the agitator and that the flow separating means has an outer diameter substantially equal to an inner diameter of the circular opening of the end plate of the perforated strainer.

DETAILED DESCRIPTION OF DISCLOSURE

The underwater sand pump according to this invention is hereinafter disclosed in conjunction with attached drawings.

Figure 1:
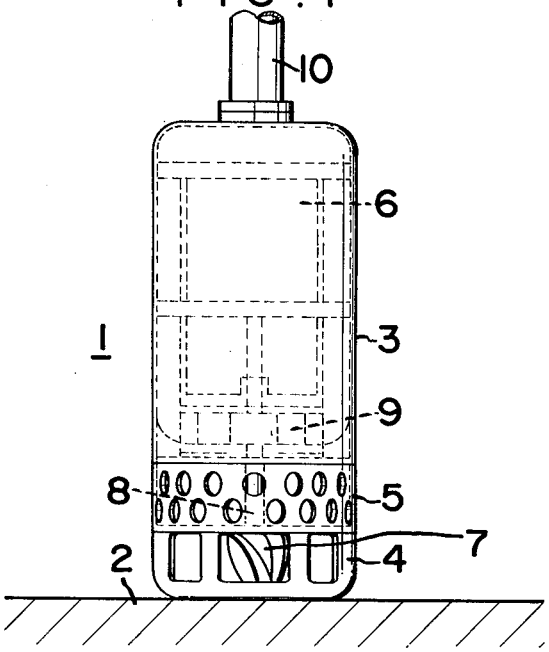
FIG. 1 is an elevational view of an underwater sand pump of the present invention.

In FIG. 1, an underwater sand pump 1 is vertically stood on a water bed 2 and such sand pump 1 substantially comprises an elongated vertical pump body 3 which is supported on the water bed 2 by means of a support strut 4, a perforated cylindrical strainer 5 which is disposed between the vertical pump body 3 and the support strut 4, a motor 6 which is encased in the pump body 3, an agitator 7 which is fixedly mounted on the lower end of an output shaft 8 of the motor 6, an impeller 9 fixedly mounted on the output shaft 8 and a sand transfer duct 10 which has one end communicated with the upper end of the sand pump 1. The perforated cylindrical strainer defines a cylindrical suction chamber.

Figure 2:
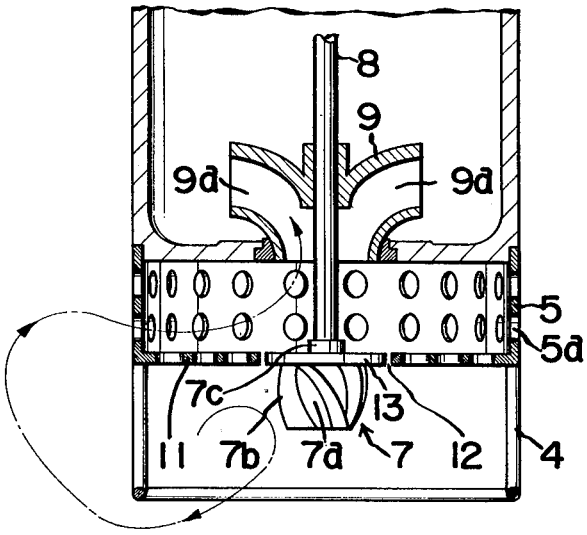
FIG. 2 is a longitudinal cross sectional view of the lower part of the above sand pump.

The lower part of the sand pump 1 where the sand agitating flow and the sand suction flow are produced by the agitator 7 and the impeller 9 respectively upon rotation of the output shaft 8 of the motor 6 is shown in FIG. 2.

In the drawing, numeral *9a* indicates a suction opening formed in the impeller 9. The perforated cylindrical strainer 5 is provided with a horizontal end plate 11 at the lower end thereof which is also perforated. The end plate 11 is provided with a circular opening 12 through which the output shaft 8 passes. As can be readily seen from FIG. 2, the agitator 7 is substantially disposed just below the circular opening 12 and consists of a truncated cone *7a*, a plurality of vanes *7b* radially attached to the peripheral wall of the truncated cone *7a* and a connecting boss *7c* means of which the agitator 7 is fixedly connected to the lower end of the output shaft 8. Flow separating means 13 is integrally and contiguously attached to the upper end of the truncated cone *12a* and is disposed in the circular opening 12. Due to such construction, there exist no space between the agitator 7 and the flow separating means 13 which has been the cause of cavitation.

Figure 3:
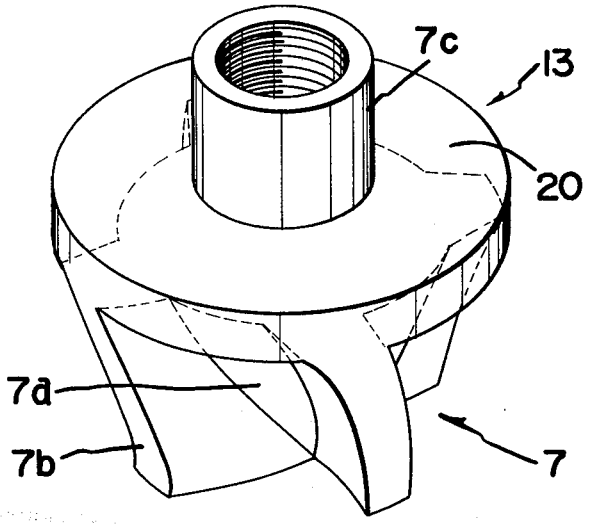
FIG. 3 is a perspective view of the agitator of the above sand pump.

In FIG. 2 and FIG. 3, the flow separating means 13 is constructed such that a circular plate 20 has the outer periphery thereof integrally merged into the upper ends of the vanes *7b*.

Figure 4:
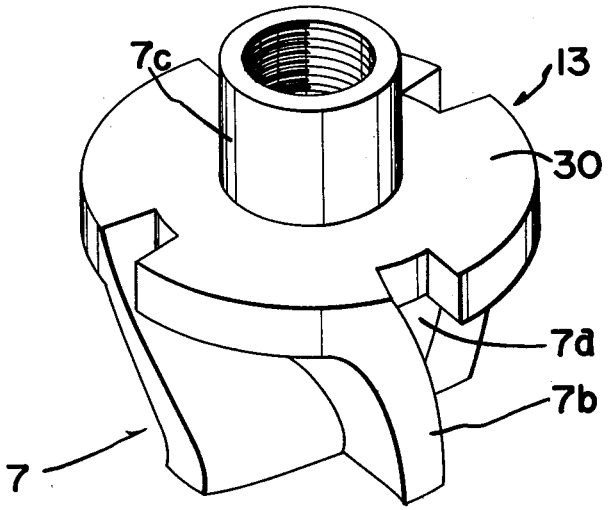
FIG. 4 to FIG.6 are perspective views of the modifications of the agitator of the above sand pump.
Figure 5:
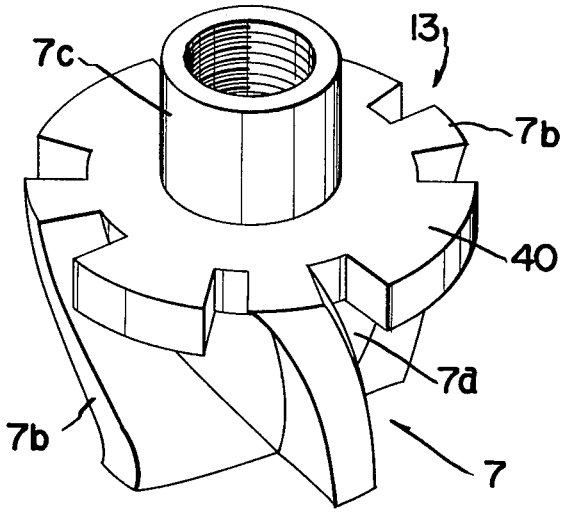
Figure 6:
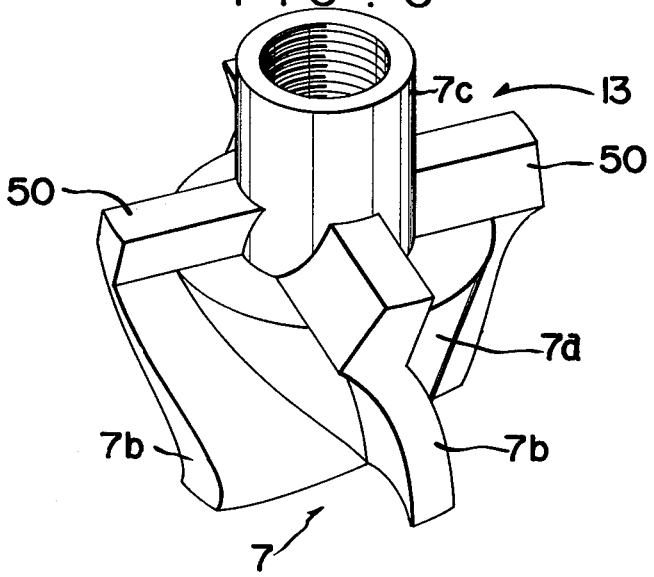

However, such flow separating means 13 can also be constructed as shown in FIG. 4 to FIG. 6. Namely, in FIG. 4, the flow separating means 13 consists of a plurality of fan-shaped horizontal plates 30 extending in a circumferential direction, wherein fan-shaped horizontal plates 30 have the proximal ends thereof merged into the upper ends of the vanes 7b of the agitator 7. In FIG. 5, the flow separating means 13 consists of a plurality of fan-shaped horizontal plates 40 extending in a circumferential direction and each fan-shaped horizontal plate 40 is disposed between each two vanes 7b. In FIG. 6, the flow separating means 13 consists of a plurality of axial extensions 50 which have the proximal ends thereof merged to the upper ends of the vanes 7b and the axial extensions 50 are inclined in a direction opposed to the inclining direction of the vanes 7b of the agitator 7.

The manner in which the underwater sand pump of the above construction is operated is hereinafter explained in view of FIG. 1 to FIG. 3.

When the output shaft 8 is driven or rotated so as to cause the simultaneous rotation of the agitator 7 and the impeller 9, the water flows in an arrow direction as shown in FIG. 2. This water flow makes the sands on the sea bed 2 whirl in an upward direction. Subsequently, the water flow which contains the whirled sand is sucked into the pump 3 by way of the apertures 5a of the perforated strainer 5 and a suction opening 9a of the impeller 9.

As has been described above, the underwater pump of this invention can produce a smooth water flow around the agitator 7 which is free from cavitation so that the occurrence of vibration of the output shaft 8 or the formation of bubbles, both of which lead to the inefficient sand excavating operation, can be effectively prevented, while damage which may be caused by the hitting of small stones contained in the whirled sand on the output shaft 8 can also be prevented.

Accordingly, the sand excavating efficiency of the underwater sand pump can be greatly enhanced, while the life of the pump is also greatly prolonged.

What we claim is:

1. An underwater sand pump adapted to be vertically disposed on a water bed and operable to evacuate sand and the like from said water bed, comprising a pump casing, an underwater motor mounted in said pump casing, said motor having an output shaft, said output shaft having its axis generally vertically disposed during operation of said pump, said output shaft having a lower longitudinal end portion, an agitator fixedly mounted on said end portion, said agitator comprising a truncated cone and a plurality of vanes radially mounted on the circumferential wall of said truncated cone, an impeller fixedly mounted on said output shaft, said impeller having a suction inlet generally axially aligned with the axis of said output shaft, an end plate disposed in a plane perpendicular to the axis of said output shaft and located between said suction inlet and said agitator, a cylindrical strainer on said pump casing and having its axis coincident with the axis of said output shaft, said cylindrical strainer being disposed between said end plate and said suction inlet to thereby define a cylindrical suction chamber between said suction inlet and said end plate, said suction inlet opening up into said cylindrical suction chamber, and flow separating means for separating agitation flow created by the operation of said agitator from said suction chamber, said flow separating means being integrally formed on an upper end of said truncated cone, said end plate having means thereon defining a circular opening, said flow separating means having substantially the same diameter as the diameter of said circular opening such that there is substantially no space between the outer periphery of said flow separating means and said circular opening to thereby preclude cavitation, said agitator agitating said water bed and causing sand and the like to pass upwardly and radially outwardly of said end plate through said circular strainer into said suction chamber to said inlet of said impeller.

2. An underwater sand pump according to claim 1, wherein said flow separating means consists of a circular plate which has the bottom periphery thereof integrally merged into the upper ends of said vanes of said agitator.

3. An underwater sand pump according to claim 1, wherein said flow separating means consists of a plurality of fan-shaped horizontal plates extending in a circumferential direction, each of said fan-shaped horizontal plates having the proximal end thereof merged into the upper ends of said vanes of said agitator.

4. An underwater sand pump according to claim 1, wherein said flow separating means consists of a plurality of fan-shaped horizontal plates extending in a circumferential direction and each of said fan-shaped horizontal plates is disposed between each two vanes.

5. An underwater sand pump according to claim 1, wherein said pump casing is supported by a support structure adapted to be supported on said water bed, said support structure being disposed below the level of said end plate, said support structure having a plurality of openings, said agitator being disposed within said support structure such that agitated material flows radially outwardly through said plurality of openings and then upwardly and radially outwardly of said end plate to subsequently pass through said circular strainer.

6. An underwater sand pump according to claim 1, wherein said agitator vanes are inclined relative to the axis of said output shaft, said flow separating means comprising a plurality of axial extensions which have proximal ends thereof merged into said vanes, said axial extensions being inclined relative to the axis of said output shaft, said inclination of said agitator vanes being opposite to the inclination of said axial extensions such that said agitator vanes and said axial extensions intersect one another at an angle less than 180 degrees.

7. An underwater sand pump adapted to be vertically disposed on a water bed and operable to evacuate sand and the like from said water bed, comprising a pump casing, an underwater motor mounted in said pump casing, said motor having an output shaft, said output shaft having its axis generally vertically disposed during operation of said pump, said output shaft having a lower longitudinal end portion, an agitator fixedly mounted on said end portion, said agitator comprising a truncated cone and a plurality of agitator vanes radially mounted on the circumferential wall of said truncated cone, an impeller fixedly mounted on said output shaft, said impeller having a suction inlet generally axially aligned with the axis of said output shaft, an end plate disposed in a plane perpendicular to the axis of said output shaft and located between said suction inlet and said agitator, a cylindrical strainer on said pump casing and having its axis coincident with the axis of said output shaft, said cylindrical strainer defining a cylindrical suction chamber, said cylindrical strainer being disposed between said end plate and said suction inlet, said suction inlet opening up into said cylindrical suction chamber, flow separating means for separating agitation flow created by the operation of said agitator and suction flow created by the operation of said impeller, said flow separating means being integrally formed on an upper end of said truncated cone, said agitator vanes being inclined relative to the axis of said output shaft, said flow separating means comprising a plurality of axial extensions which have proximal ends thereof merged into said vanes, said axial extensions being inclined relative to the axis of said output shaft, said inclination of said agitator vanes being opposite to the inclination of said axial extensions such that said agitator vanes and said axial extensions intersect one another at an angle of less than 180 degrees, said end plate having means thereof defining a circular opening, said axial extensions having substantially the same diameter as the diameter of said circular opening such that there is substantially no space between the outer periphery of said axial extensions and said circular opening to thereby preclude cavitation, said pump casing being supported by a support structure adapted to be supported on said water bed, said support structure being disposed below the level of said end plate, said support structure having a plurality of openings, said agitator being disposed within said support structure such that agitated material flows radially outwardly through said plurality of openings and then upwardly and radially outwardly of said end plate to subsequently pass through said circular strainer into said suction chamber to said inlet of said impeller.

* * * * *